US008831451B2

(12) United States Patent
Matsui

(10) Patent No.: US 8,831,451 B2
(45) Date of Patent: Sep. 9, 2014

(54) IMAGE FORMING APPARATUS

(71) Applicant: Kyocera Document Solutions Inc., Osaka (JP)

(72) Inventor: Kenshi Matsui, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 13/828,579

(22) Filed: Mar. 14, 2013

(65) Prior Publication Data

US 2013/0243461 A1 Sep. 19, 2013

(30) Foreign Application Priority Data

Mar. 16, 2012 (JP) ..... 2012-061112

(51) Int. Cl.

| | |
|---|---|
| ***G03G 15/08*** | (2006.01) |
| ***G03G 15/00*** | (2006.01) |
| ***G03G 15/095*** | (2006.01) |
| ***G03G 15/09*** | (2006.01) |

(52) U.S. Cl.

CPC ..... *G03G 15/095* (2013.01); *G03G 15/5058* (2013.01); *G03G 15/5041* (2013.01); *G03G 15/0907* (2013.01)

USPC ..... 399/55; 399/270

(58) Field of Classification Search

USPC ..... 399/55, 270

See application file for complete search history.

(56) References Cited

U.S. PATENT DOCUMENTS

2009/0067890 A1 * 3/2009 Maeyama et al. ..... 399/273

FOREIGN PATENT DOCUMENTS

| | | |
|---|---|---|
| JP | 2000-081788 A | 3/2000 |
| JP | 2005-157002 A | 6/2005 |

* cited by examiner

*Primary Examiner* — Clayton E Laballe
*Assistant Examiner* — Jas Sanghera
(74) *Attorney, Agent, or Firm* — Knobbe Martens Olson & Bear LLP

(57) ABSTRACT

The developing device includes a toner layer formation control unit instructing a voltage control unit to set a first voltage difference to form a toner layer on a surface of a toner supporting rotator, a stripping control unit that instructs the voltage control unit to, in a toner layer stripping mode, set a second voltage difference that moves substantially an entire amount of toner composing the toner layer to a developer supporting rotator, and a density detection unit detecting the toner density on a transfer member onto which a toner image is primarily transferred. When the toner remains on a surface of the toner supporting rotator, the stripping control unit causes the toner to fly to the surface of the image carrier, while outputting an instruction adjusting the second voltage difference to the voltage control unit in order to reduce the toner density detected by the toner density detection unit.

4 Claims, 8 Drawing Sheets

IMAGE FORMING APPARATUS

INCORPORATION BY REFERENCE

This application is based on and claims the benefit of priority from Japanese Patent Application No. 2012-061112, filed on Mar. 16, 2012, the content of which is incorporated herein by reference.

BACKGROUND

The present disclosure relates to an image forming apparatus provided with a developing device for developing an electrostatic latent image formed by electrophotography.

A developing device employing a so-called touch-down type (also referred to as a hybrid type) is known. In an apparatus employing this type, a two-component developer including at least a carrier and toner is supported on a surface of a developer supporting rotator to form a magnetic brush on the surface by the carrier. The toner supplied from the magnetic brush to a toner supporting rotator forms a toner layer on a surface of the toner supporting rotator, such that the toner flies from the toner layer to an image carrier. In this manner, an electrostatic latent image on a surface of the image carrier is developed into a toner image.

In the developing device of the touch-down type, a so-called development history may easily occur, which is a difference in developing performance at a time of subsequent rotation of the toner supporting rotator between two parts of the toner supporting rotator. One part is where toner is used by development and another part is where unused toner remains on the surface of the toner supporting rotator, of the toner of the toner layer formed on the surface of the toner supporting rotator. Such a development history results in unevenness of the toner layer formed on the surface of the toner supporting rotator at a time of the subsequent rotation. As a result, it my be that a reduction in density of an image occurs due to a change in toner characteristics (particle size, triboelectric charge and the like), degraded image quality occurs due to long-neglected undeveloped toner, and scattering of the toner and developing defect such as developing ghost occurs.

In order to suppress an occurrence of the abovementioned developing defect, stripping of the undeveloped toner layer on the surface of the toner supporting rotator and formation of a new toner layer on the surface of the toner supporting rotator are performed between two successive operations of development and at a time without transferring. In this case, it is possible to improve the developing ghost if the stripping performance of the undeveloped toner layer (increasing stripping of the undeveloped toner) is prioritized. However, it is likely that the image density may decrease due to insufficient formation of the new toner layer. On the other hand, if formation of a new toner layer (increasing thickness of the toner layer) is prioritized, the reduced image density will not occur. However, the developing ghost may worsen.

In order to satisfy the need of solving the problems of developing ghost and reduced image density, it is performed to set various values to an AC/DC superposed bias voltage that is applied to the developer supporting rotator and the toner supporting rotator. However, since the magnitude of DC component has a great impact on a thickness of the toner layer, it influences density and quality of an image. In addition, if an AC voltage component is increased, stripping performance of the undeveloped toner layer from the toner supporting rotator increases and the developing ghost is improved. However, the developer may easily stay in a nip portion. Accordingly, it is likely that the blockage caused by the developer occurs at the nip portion and the leakage due to an excessive bias voltage occurs.

In order to avoid abovementioned side effects, the bias voltage must be set to an optimal value. However, the optimal bias voltage value depends greatly on an amount of charged electricity and the like of the developer, and the amount of charged electricity and the like of the developer depend greatly on humidity, temperature and the like. In other words, the optimal bias voltage value depends on environmental conditions under which the image forming apparatus is placed.

Furthermore, the toner layer stripping performance of the developing device of the touch-down type is also greatly influenced by a size of a gap between the developer supporting rotator and the toner supporting rotator. Since the gap depends on the manufacturing accuracy, assembly accuracy and the like of components, the gap varies from one image forming apparatus to another. Accordingly, the optimal bias voltage value varies from one image forming apparatus to another.

A developing device is known, in which two magnetic rollers are configured for dedicated functions of toner layer formation and toner layer stripping, respectively, in order to solve the abovementioned problems. More specifically, the two magnetic rollers are arranged opposite to the toner supporting rotator. One of the two magnetic rollers is dedicated to a developer supporting function for forming a toner layer on the toner supporting rotator and the other is dedicated to a stripping function of an undeveloped toner layer on the surface of the toner supporting rotator.

However, if the two magnetic rollers are installed inside the main body of the abovementioned developing device, it is necessary to apply bias voltages of different values to the two magnetic rollers. This makes the mechanism of the developing device complex, and increases the size of the entire image forming apparatus for securing a space for accommodating large magnetic rollers inside the developing device.

SUMMARY

In an aspect of the present invention, an image forming apparatus includes a developing device, an image carrier and a density detection unit.

The developing device includes a developer supporting rotator, a toner supporting rotator, a voltage application unit, a voltage control unit, a toner layer formation control unit and a stripping control unit.

The developer supporting rotator is configured to magnetically support a two-component developer including at least a carrier and toner, on a surface of which a magnetic brush is formed by the carrier included in the two-component developer.

The toner supporting rotator is arranged opposite to the developer supporting rotator and configured to support the toner supplied from the developer supporting rotator and to form a toner layer by the magnetic brush.

The voltage application unit is configured to apply a first bias voltage to the developer supporting rotator and a second bias voltage to the toner supporting rotator in order to apply a developing bias voltage between the toner supporting rotator and the image carrier, such that the toner supported by the toner supporting rotator flies to an electrostatic latent image on a surface of the image carrier and develops the electrostatic latent image into a toner image.

The voltage control unit is configured to control a voltage difference between the first bias voltage and the second bias voltage applied by the voltage application unit.

The toner layer formation control unit is configured to instruct the voltage control unit to set the voltage difference to a first voltage difference at which the toner is bidirectionally movable between the developer supporting rotator and the toner supporting rotator and the toner layer is formed on a surface of the toner supporting rotator.

A stripping control unit is configured to instruct the voltage control unit to set the voltage difference to a second voltage difference at which a substantially entire amount of toner composing the toner layer formed on the toner supporting rotator moves to the developer supporting rotator, in a toner layer stripping mode where the toner layer formed on the surface of the toner supporting rotator is stripped during rotation of the toner supporting rotator, wherein an electrostatic latent image is formed on a surface of the image carrier and a toner image is formed on the electrostatic latent image by the toner supplied from the toner layer of the developing device.

The density detection unit detects density of toner at any one of the surface of the image carrier, a transfer member onto which the toner image is primarily transferred from the image carrier, and a conveyance member that conveys a sheet of recording medium to which the toner image is transferred from the image carrier.

The stripping control unit outputs an instruction for adjusting the second voltage difference to the voltage control unit, such that the toner flies to the surface of the image carrier and the density is decreased based on the density detected by the toner density detection unit, for a case where the toner remains on the surface of the toner supporting rotator in the toner layer stripping mode.

DETAILED DESCRIPTION

An embodiment of an image forming apparatus according to the present disclosure will be described hereinafter with reference to the drawings.

Figure 1:
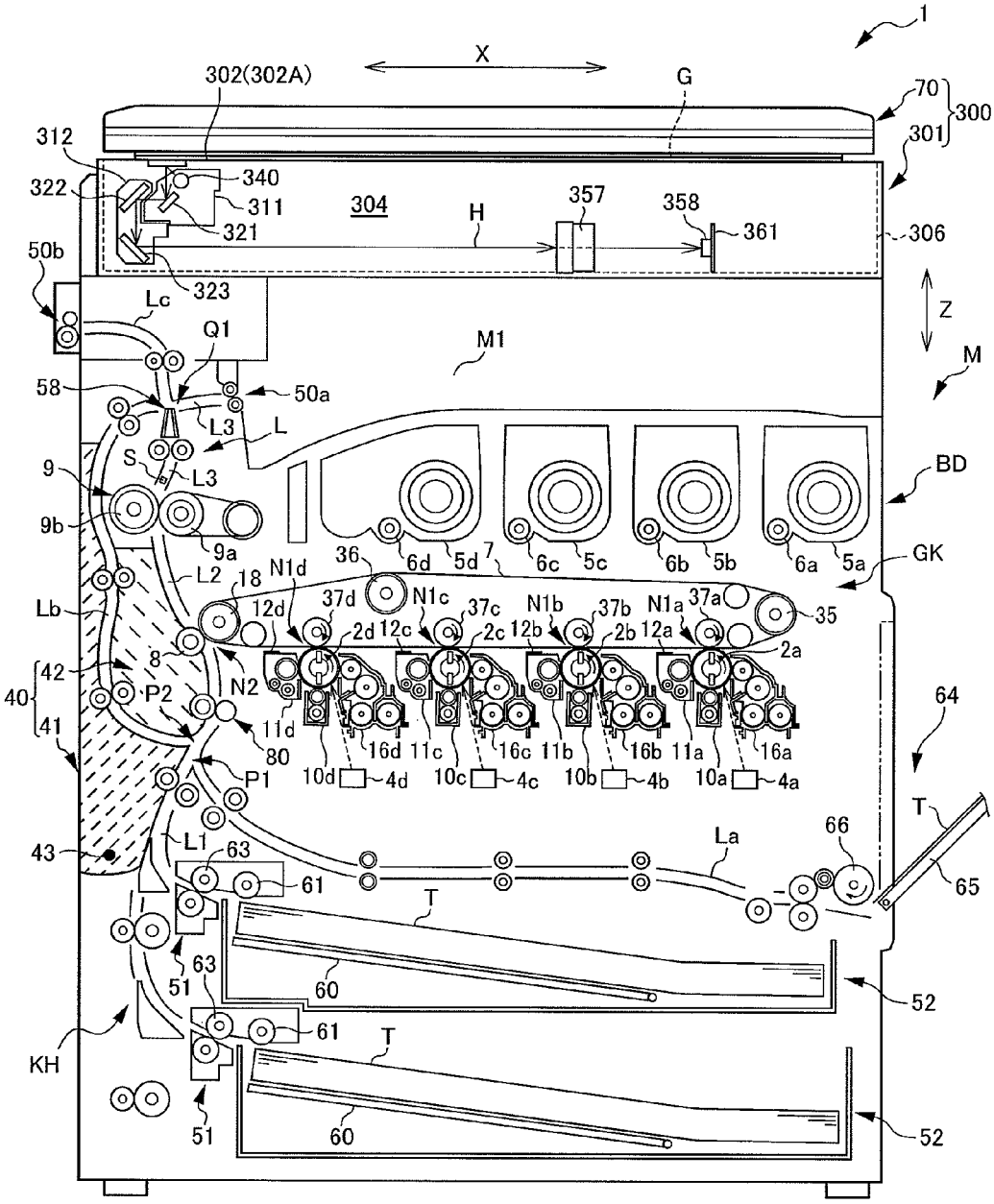
FIG. 1 is a diagram illustrating an arrangement of components of a copy machine 1.

An overall structure of a copy machine 1 as an image forming apparatus according to the present embodiment is described referring to FIG. 1. FIG. 1 is a diagram illustrating an arrangement of components of the copy machine 1.

As shown in FIG. 1, the copy machine 1 as the image forming apparatus includes an image reading device 300 and a main body M. The image reading device 300 is disposed in an upper portion of the copy machine 1 in a vertical direction Z. The main body M is disposed on a lower side in the vertical direction Z in the copy machine 1, and a toner image is formed on a sheet of paper T as a sheet-shaped image recording medium based on the image information read by the image reading device 300.

It should be noted that, in a description of the copy machine 1, a secondary scanning direction X is also referred to as "left-right direction" and a primary scanning direction Y (a direction across FIG. 1) is also referred to as "front-rear direction" of the copy machine 1. The vertical direction Z of the copy machine 1 is orthogonal to the secondary scanning direction X and the primary scanning direction Y.

First, the image reading device 300 is described.

As shown in FIG. 1, the image reading device 300 includes a cover 70 and a reading unit 301 that reads an image on a document G.

The cover 70 is connected openably and closably with the reading unit 301 by a connecting portion (not illustrated). The cover 70 protects a reading surface 302A (described later).

The reading unit 301 includes a housing 306 and the reading surface 302A disposed on an upper side of the housing 306. In addition, the reading unit 301 includes an illumination unit 340 including a light source disposed in an internal space 304 of the housing 306, a plurality of mirrors 321, 322, and 323, a first frame body 311 and a second frame body 312 that move in the secondary scanning direction X, an imaging lens 357, a CCD 358 as a reading device, and a CCD printed board 361 that performs a predetermined process on image information read by the CCD 358 and outputs the image information to the main body M. The illumination unit 340 and the mirror 321 are accommodated in the first frame body 311. The second mirror 322 and the third mirror 323 are accommodated in the second frame body 312.

The reading surface 302A extends in an in-plane direction defined by the secondary scanning direction X and the primary scanning direction Y, and occupies a large part of the reading unit 301 in the secondary scanning direction X. A document G is placed on the reading surface 302A. The first frame body 311 and the second frame body 312 move in the secondary scanning direction X while maintaining a length of a light path H (described later) constant. As a result, an image of the document G placed on the reading surface 302A is read.

In the internal space 304 of the housing 306, the plurality of mirrors 321, 322 and 323 forms the light path H so that light from the document G is incident upon the imaging lens 357. In addition, since the first frame body 311 moves in a secondary scanning direction X at a predetermined speed A while the second frame body 312 moves in the secondary scanning direction X at a predetermined speed A/2, the length of the light path H is kept constant while reading of an image is performed. Details of the reading unit 301 will be described later.

Next, the main body M is described.

The main body M includes an image forming unit GK that forms a predetermined toner image on a sheet of paper T based on predetermined image information, and a paper feeding/discharge unit KH that feeds the sheet of paper T to the image forming unit GK and discharges the sheet of paper T on which a toner image is formed.

The external shape of the main body M is composed of a cabinet BD as the housing.

As shown in FIG. 1, the image forming unit GK includes photosensitive drums 2*a*, 2*b*, 2*c*, and 2*d* as image carriers (photosensitive bodies), charging units 10*a*, 10*b*, 10*c*, and 10*d*, laser scanner units 4*a*, 4*b*, 4*c*, and 4*d* as exposure units, developing devices 16*a*, 16*b*, 16*c*, and 16*d*, toner cartridges 5*a*, 5*b*, 5*c*, and 5*d*, toner feeding units 6*a*, 6*b*, 6*c*, and 6*d*, drum cleaning units 11*a*, 11*b*, 11*c*, and 11*d*, static eliminator 12*a*, 12*b*, 12*c*, and 12*d*, an intermediate transfer belt 7, primary transfer rollers 37*a*, 37*b*, 37*c*, and 37*d*, a secondary transfer roller 8, an opposing roller 18, and the fusing unit 9.

As shown in FIG. 1, the paper feeding/discharge unit KH includes a paper feeding cassette 52, a manual feeding unit 64, a paper path L for a sheet of paper T, a pair of registration rollers 80, a first discharge portion 50*a*, and a second discharge portion 50*b*. It should be noted that the paper path L includes a first paper path L1, a second paper path L2, a third paper path L3, a manual paper path La, a reverse paper path Lb, and a post-processing paper path Lc.

Components of the image forming unit GK and the paper feeding/discharge unit KH are described in detail hereinafter.

First, a description is provided for the image forming unit GK.

In the image forming unit GK, charging by the charging units 10*a*, 10*b*, 10*c* and 10*d*, exposure by the laser scanner units 4*a*, 4*b*, 4*c* and 4*d*, development by the developing devices 16*a*, 16*b*, 16*c* and 16*d*, primary image transfer by the intermediate transfer belt 7 and the primary transfer rollers 37*a*, 37*b*, 37*c* and 37*d*, static elimination by the static eliminators 12*a*, 12*b*, 12*c* and 12*d*, and cleaning by the drum cleaning units 11*a*, 11*b*, 11*c* and 11*d*, are performed sequentially on surfaces of the photosensitive drums 2*a*, 2*b*, 2*c* and 2*d*, from an upstream side to a downstream side.

In addition, secondary image transfer by the intermediate transfer belt 7, the secondary transfer roller 8 and the opposing roller 18, and fusion by the fusing unit 9 are performed in the image forming unit GK.

Each of the photosensitive drums 2*a*, 2*b*, 2*c*, and 2*d* is cylindrically shaped and functions as a photosensitive body or an image carrier. Each of the photosensitive drums 2*a*, 2*b*, 2*c*, and 2*d* is disposed rotatable in a direction of an arrow, about a shaft orthogonal to a direction of movement of the intermediate transfer belt 7. An electrostatic latent image is formed on a surface of each of the photosensitive drums 2*a*, 2*b*, 2*c*, and 2*d*.

Each of the charging units 10*a*, 10*b*, 10*c*, and 10*d* is disposed opposite to a surface of the photosensitive drums 2*a*, 2*b*, 2*c*, and 2*d*. Each of the charging units 10*a*, 10*b*, 10*c*, and 10*d* negatively (negative polarity) or positively (positive polarity) charges a surface of each of the photosensitive drums 2*a*, 2*b*, 2*c*, and 2*d* uniformly.

Each of the laser scanner units 4*a*, 4*b*, 4*c*, and 4*d*, which function as the exposure units, is disposed to be spaced apart from a surface of the photosensitive drums 2*a*, 2*b*, 2*c*, and 2*d*. The laser scanner units 4*a*, 4*b*, 4*c*, and 4*d* include, respectively, a laser light source, a polygon mirror, a polygon mirror driving motor and the like, which are not illustrated.

Each of the laser scanner units 4*a*, 4*b*, 4*c*, 4*d* scans and exposes a surface of each of the photosensitive drums 2*a*, 2*b*, 2*c*, 2*d* based on the information related to the image read by the reading unit 301. In this way, an electric charge of an exposed part of a surface of each of the photosensitive drums 2*a*, 2*b*, 2*c*, and 2*d* is removed. An electrostatic latent image is thus formed on a surface of each of the photosensitive drums 2*a*, 2*b*, 2*c*, and 2*d*.

The developing devices 16*a*, 16*b*, 16*c*, and 16*d* are disposed to correspond to the photosensitive drums 2*a*, 2*b*, 2*c*, and 2*d*, respectively, opposite to respective surfaces of the photosensitive drums 2*a*, 2*b*, 2*c*, and 2*d*. Each of the developing devices 16*a*, 16*b*, 16*c*, and 16*d* forms a color toner image on a surface of each of the photosensitive drums 2*a*, 2*b*, 2*c*, and 2*d* by depositing toners of various colors on an electrostatic latent image formed on the surface of each of the photosensitive drums 2*a*, 2*b*, 2*c*, and 2*d*. The developing devices 16*a*, 16*b*, 16*c*, and 16*d* correspond to four colors of yellow, cyan, magenta, and black, respectively. The developing devices 16*a*, 16*b*, 16*c*, and 16*d* include developing rollers that are disposed to face the surfaces of the photosensitive drums 2*a*, 2*b*, 2*c*, and 2*d*, agitation rollers for agitating toners and the like, respectively. Details of the developing devices 16*a*, 16*b*, 16*c* and 16*d* will be described later.

The toner cartridges 5*a*, 5*b*, 5*c*, and 5*d* are provided corresponding to the developing devices 16*a*, 16*b*, 16*c*, and 16*d*, respectively, and store the toners of different colors that are supplied to the developing devices 16*a*, 16*b*, 16*c*, and 16*d*, respectively. The toner cartridges 5*a*, 5*b*, 5*c*, and 5*d* store toners of yellow, cyan, magenta, and black respectively.

The toner feeding units 6*a*, 6*b*, 6*c*, and 6*d* are provided to correspond to the toner cartridges 5*a*, 5*b*, 5*c*, and 5*d* and the developing devices 16*a*, 16*b*, 16*c*, and 16*d*, respectively. And the toner feeding units 6*a*, 6*b*, 6*c*, and 6*d* supply the toners of the respective colors stored in the toner cartridges 5*a*, 5*b*, 5*c*, and 5*d* to the developing devices 16*a*, 16*b*, 16*c*, and 16*d*, respectively. The toner feeding units 6*a*, 6*b*, 6*c*, and 6*d* are connected with the developing devices 16*a*, 16*b*, 16*c*, and 16*d*, respectively, via toner feeding paths (not illustrated).

Toner images of respective colors formed on the photosensitive drums 2*a*, 2*b*, 2*c*, and 2*d* are primarily transferred in sequence to the intermediate transfer belt 7. The intermediate transfer belt 7 is stretched around a driven roller 35, the opposing roller 18 as a driving roller, a tension roller 36 and the like. As the tension roller 36 biases the intermediate transfer belt 7 from inside to outside, a predetermined tension is applied to the intermediate transfer belt 7.

Primary transfer rollers 37*a*, 37*b*, 37*c*, and 37*d* are arranged opposite to the photosensitive drums 2*a*, 2*b*, 2*c*, and 2*d*, respectively, across the intermediate transfer belt 7.

Predetermined parts of the intermediate transfer belt 7 are sandwiched between the primary transfer rollers 37*a*, 37*b*, 37*c*, and 37*d* and the photosensitive drums 2*a*, 2*b*, 2*c*, and 2*d*. The predetermined sandwiched parts are pressed against surfaces of the photosensitive drums 2*a*, 2*b*, 2*c*, and 2*d*. Primary transfer nips N1*a*, N1*b*, N1*c*, and N1*d* are thus formed between the photosensitive drums 2*a*, 2*b*, 2*c*, and 2*d* and the primary transfer rollers 37*a*, 37*b*, 37*c*, and 37*d*, respectively. At the primary transfer nips N1*a*, N1*b*, N1*c*, and N1*d*, toner images of the respective colors developed on the photosensitive drums 2*a*, 2*b*, 2*c*, and 2*d* undergo primary transfer sequentially onto the intermediate transfer belt 7. In this manner, a full-color toner image is formed on the intermediate transfer belt 7.

A primary image transfer bias is applied to each of the primary transfer rollers 37*a*, 37*b*, 37*c*, and 37*d* by a primary image transfer bias application unit (not illustrated). Due to the primary image transfer bias, a toner image of each color formed on each of the photosensitive drums 2*a*, 2*b*, 2*c*, and 2*d* is transferred onto the intermediate transfer belt 7.

Each of the static eliminators 12*a*, 12*b*, 12*c*, and 12*d* is disposed so as to face a surface of each of the photosensitive drums 2*a*, 2*b*, 2*c*, and 2*d*. The static eliminators 12*a*, 12*b*, 12*c*, and 12*d* each remove electricity (eliminate an electrical charge) from a surface of each of the photosensitive drums 2*a*, 2*b*, 2*c*, and 2*d* after the primary image transfer, by casting light on the surface of each of the photosensitive drums 2*a*, 2*b*, 2*c*, and 2*d*.

Each of the drum cleaning units 11*a*, 11*b*, 11*c*, and 11*d* is arranged opposite to a surface of the photosensitive drums 2*a*, 2*b*, 2*c*, and 2*d*. The drum cleaning units 11*a*, 11*b*, 11*c*, and 11*d* remove toner and attached matter remaining on the surfaces of the photosensitive drums 2*a*, 2*b*, 2*c*, and 2*d*, respectively, and transfer the removed toner to a collection mechanism. The toner and the like thus conveyed are collected by the collection mechanism.

The secondary transfer roller 8 secondarily transfers the full-color toner image, which has been primarily transferred to the intermediate transfer belt 7, to a sheet of paper T. A secondary bias is applied to the secondary transfer roller 8 to transfer the full-color toner image formed on the intermediate transfer belt 7 to the sheet of paper T by the primary transfer bias application unit (not illustrated).

The secondary transfer roller 8 comes into contact with and moves away from the intermediate transfer belt 7. More specifically, the secondary transfer roller 8 is configured to be movable between a contact position at which it is in contact with the intermediate transfer belt 7 and a spaced position at which it is spaced apart from the intermediate transfer belt 7. In particular, the secondary transfer roller 8 is disposed at the contact position for transferring the toner image primarily transferred to a surface of the intermediate transfer belt 7 to the sheet of paper T, and at the spaced position in all other circumstances.

The opposing roller 18 is arranged opposite to the secondary transfer roller 8 across the intermediate transfer belt 7. A predetermined part of the intermediate transfer belt 7 is sandwiched between the secondary transfer roller 8 and the opposing roller 18. The sheet of paper T is pressed against an outer surface (a surface to which the toner image is primarily transferred) of the intermediate transfer belt 7. A secondary transfer nip N2 is formed between the secondary transfer roller 8 and the opposing roller 18. At the secondary transfer nip N2, the full-color toner image primarily transferred to the intermediate transfer belt 7 is secondarily transferred to the sheet of paper T.

The fusing unit 9 fuses and pressurizes respective color toners forming the toner image that has been secondarily transferred to the sheet of paper T, such that the color toners are fused on the sheet of paper T. The fusing unit 9 includes a heating rotator 9*a* that is heated by a heater, and a pressing rotator 9*b* that is brought into pressure-contact with the heating rotator 9*a*. The heating rotator 9*a* and the pressing rotator 9*b* sandwich and compress the sheet of paper T to which the toner image is secondarily transferred, while feeding the sheet of paper T. As a result, the toner transferred onto the sheet of paper T is fused, pressurized and fused onto the sheet of paper T.

Next, the paper feeding/discharge unit KH is described.

As shown in FIG. 1, two paper feeding cassettes 52 for accommodating sheets of paper T are disposed one above the other at a lower portion of the main body M. The paper feeding cassette 52 is configured to be manually drawable in a horizontal direction from a housing of the main body M. The paper feeding cassette 52 includes a paper tray 60 on which sheets of paper T are placed. The paper feeding cassette 52 stores the sheets of paper T stacked on the sheet of paper tray 60. The sheets of paper T placed on the paper tray 60 are fed to the paper path L by a cassette feeding unit 51 disposed in an end portion of the paper feeding cassette 52 on a side of feeding the paper (in a left end portion of FIG. 1). The cassette feeding unit 51 includes a double feed prevention mechanism including a forward feed roller 61 for picking up a sheet of paper T on the paper tray 60 and a pair of paper feeding rollers 63 for feeding the sheets of paper T sheet by sheet to the paper path L.

The manual feeding unit 64 is provided on a right lateral face (the right side in FIG. 1) of the main body M. The manual feeding unit 64 is provided in order to feed other sheets of paper T to the main body M, which are different in size and type from the sheets of paper T accommodated in the paper feeding cassette 52. The manual feeding unit 64 includes a manual feeding tray 65, which becomes a portion of a right lateral face of the main body M when the manual feeding unit 64 is closed, and a paper feeding roller 66. A lower end of the manual feeding tray 65 is rotatably attached in a vicinity of the paper feeding roller 66 (openable and closable). A sheet or sheets of paper T are placed on the manual feeding tray 65 while it is open. The paper feeding roller 66 feeds a sheet of paper T placed on the manual feeding tray 65 while it is open to the manual feeding path La.

A first discharge portion 50*a* and a second discharge portion 50*b* are provided on an upper side of the main body M. The first discharge portion 50*a* and the second discharge portion 50*b* discharge a sheet of paper T outside the main body M. The first discharge portion 50*a* and the second discharge portion 50*b* will be described later in detail.

The paper path L includes the first paper path L1 from the cassette feeding unit 51 to the secondary transfer nip N2, the second paper path L2 from the secondary transfer nip N2 to the fusing unit 9, the third paper path L3 from the fusing unit 9 to the first discharge portion 50*a*, the manual paper path La that guides a sheet of paper T fed from the manual feeding unit 64 to the first paper path L1, the reverse paper path Lb that reverses and returns a sheet of paper T that is conveyed in the third paper path L3 from upstream to downstream to the first paper path L1, and the post-processing paper path Lc that conveys a sheet of paper T that is conveyed in the third paper path L3 from upstream to downstream to a post-processing device (not shown) connected to the second discharge portion 50*b*.

In addition, a first junction P1 and a second junction P2 are provided midway in the first paper path L1. A first branch part Q1 is provided midway in the third paper path L3.

The manual paper path La merges with the first paper path L1 at the first junction P1. The reverse paper path Lb merges with the first paper path L1 at the second junction P2.

The post-processing paper path Lc branches off from the third paper path L3 at the first branch portion Q1. A switching member 58 is provided at the first branch portion Q1. The switching member 58 switches a conveying direction of a sheet of paper T discharged from the fusing unit 9 to the third paper path L3 toward the first discharge portion 50*a* or to the post-processing paper path Lc toward the second discharge portion 50*b*.

In addition, a sensor for detecting a sheet of paper T and a pair of registration rollers 80 for skew correction of a sheet of paper T and timing adjustment with formation of the toner image in the image forming unit GK are disposed midway in the first paper path L1 (more specifically, between the second junction P2 and the secondary transfer roller 8). The sensor is disposed immediately before the pair of registration rollers 80 in the conveyance direction of a sheet of paper T (upstream in the conveyance direction). The pair of registration rollers 80 conveys the sheet of paper T by performing the aforementioned correction and timing adjustment based on a detection signal sent from the sensor.

A sensor S for detecting a sheet of paper T is disposed midway in the third paper path L3 (more specifically, between the fusing unit 9 and the first branch portion Q1). The sensor S is disposed downstream of the fusing unit 9 in the conveying direction of a sheet of paper T. The sensor S outputs a detection signal when it detects a printed sheet of paper T pass.

For a case of performing duplex printing of a sheet of paper T, the reverse paper path Lb is provided for forming an image on a surface (an unprinted surface) opposite to a surface that has already been printed. The reverse paper path Lb can reverse a sheet of paper T, fed from the first branch portion Q1 toward the discharge portion 50, and returns the sheet of paper T to the first paper path L1 in order to feed the sheet of paper T to upstream of the pair of registration rollers 80 disposed upstream of the secondary transfer roller 8. At the secondary transfer nip N2, a toner image is transferred to the unprinted surface of the sheet of paper T that has been reversed by the return paper path Lb.

The first discharge portion 50*a* is formed in an end portion of the third paper path L3. The first discharge portion 50*a* is disposed in an upper portion of the main body M. The first discharge portion 50*a* has an opening toward a right lateral face of the main body M (right side in FIG. 1 and on a side of the manual feeding unit 64). The first discharge portion 50*a* discharges a sheet of paper T that is conveyed in the third paper path L3 outside the main body M.

A discharged paper collection part M1 is formed on a side of the opening of the first discharge portion 50*a*. The discharged paper collection part M1 is formed on an upper face (outer face) of the main body M. The discharged paper collection part M1 is a portion of the upper face of the main body M recessed downward. The bottom face of the discharged paper collection part M1 constitutes a part of the upper face of the main body M. A sheet of paper T, to which a predetermined toner image is formed and which is discharged from the first discharge portion 50*a*, is stacked at the discharged paper collection part M1.

The second discharge portion 50*b* is formed in an end portion of the post-processing paper path Lc. The second discharge portion 50*b* is disposed in an upper portion of the main body M. The second discharge portion 50*b* has an opening toward a left lateral face of the main body M (left side in FIG. 1 and on a side to which the post-processing device is connected). The second discharge portion 50*b* discharges a sheet of paper T, which is conveyed in the post-processing paper path Lc, outside the main body M.

The post-processing device (not shown) is connected to a side of the opening of the second discharge portion 50*b*. The post-processing device performs post processing (stapling, punching and the like) of sheets of paper discharged from the image forming apparatus (copy machine 1).

A sensor for detecting a sheet of paper is disposed at a predetermined position of each paper path.

Next, a structure for eliminating paper jams in main paper paths L1 to L3 (the first paper path L1, the second paper path L2, and the third paper path L3 are also collectively referred to as "main paper paths" hereinafter) and in the reverse paper path Lb is briefly described.

As shown in FIG. 1, on a left lateral face side of the main body M (left side in FIG. 1), the main paper paths L1 to L3 and the reverse paper path Lb extend in parallel mainly in a vertical direction. On a left lateral face side of the main body M (left side in FIG. 1), a cover assembly 40 is provided so as to form a part of the lateral face of the main body M. A lower end portion of the cover assembly 40 is connected with the main body M via a fulcrum shaft 43. The fulcrum shaft 43 is disposed along a direction intersecting the main paper paths L1 to L3 and the reverse paper path Lb. The cover assembly 40 is configured to be pivotable about the fulcrum shaft 43 between a closed position (shown in FIG. 1) and an opened position (not illustrated).

The cover assembly 40 is composed of a first cover 41 that is connected with the main body M to be pivotable about the fulcrum shaft 43 and a second cover 42 that is connected with the main body M to be pivotable about the same fulcrum shaft 43. The first cover 41 is positioned more external (lateral face side) of the main body M than the second cover 42. It should be noted that, in FIG. 1, the first cover 41 is a part hatched with falling diagonal broken lines from top right to bottom left, and the second cover 42 is a part hatched with falling diagonal broken lines from top left to bottom right.

When the cover assembly 40 is in a closed position, an outer face of the first cover 41 constitutes a part of an outer face (lateral face) of the main body M.

In addition, when the cover assembly 40 is in the closed position, an inner face (a side of the main body M) of the second cover 42 constitutes a portion of the main paper paths L1 to L3.

Furthermore, when the cover assembly 40 is in the closed position, an inner face of the first cover 41 and an outer face of the second cover 42 constitute at least a part of the reverse paper path Lb. In other words, the reverse paper path Lb is formed between the first cover 41 and the second cover 42.

Since the copy machine 1 according to the present embodiment is provided with the cover assembly 40 thus configured, in a case in which a paper jam occurs in the main paper paths L1 to L3, jammed paper in the main paper paths L1 to L3 can be removed by opening the main paper paths L1 to L3 by pivoting the cover assembly 40 from the closed position shown in FIG. 1 to the opened position (not illustrated). On the other hand, in a case in which a paper jam occurs in the reverse paper path Lb, jammed paper in the reverse paper path Lb can be removed by opening the reverse paper path Lb by pivoting the cover assembly 40 to the opened position and then pivoting the second cover 42 about the fulcrum shaft 43 toward the main body M (right side in FIG. 1).

Next, the developing device of the present embodiment is described in detail with reference to FIGS. 2 to 7. As described above, the copy machine 1 includes four photosensitive drums 2*a*, 2*b*, 2*c*, 2*d* and four developing devices 16*a*, 16*b*, 16*c*, 16*d*, which are configured similarly to each other. Accordingly, the photosensitive drum 2*a* and the developing device 16*a* are described hereinafter as typical examples.

Figure 2:
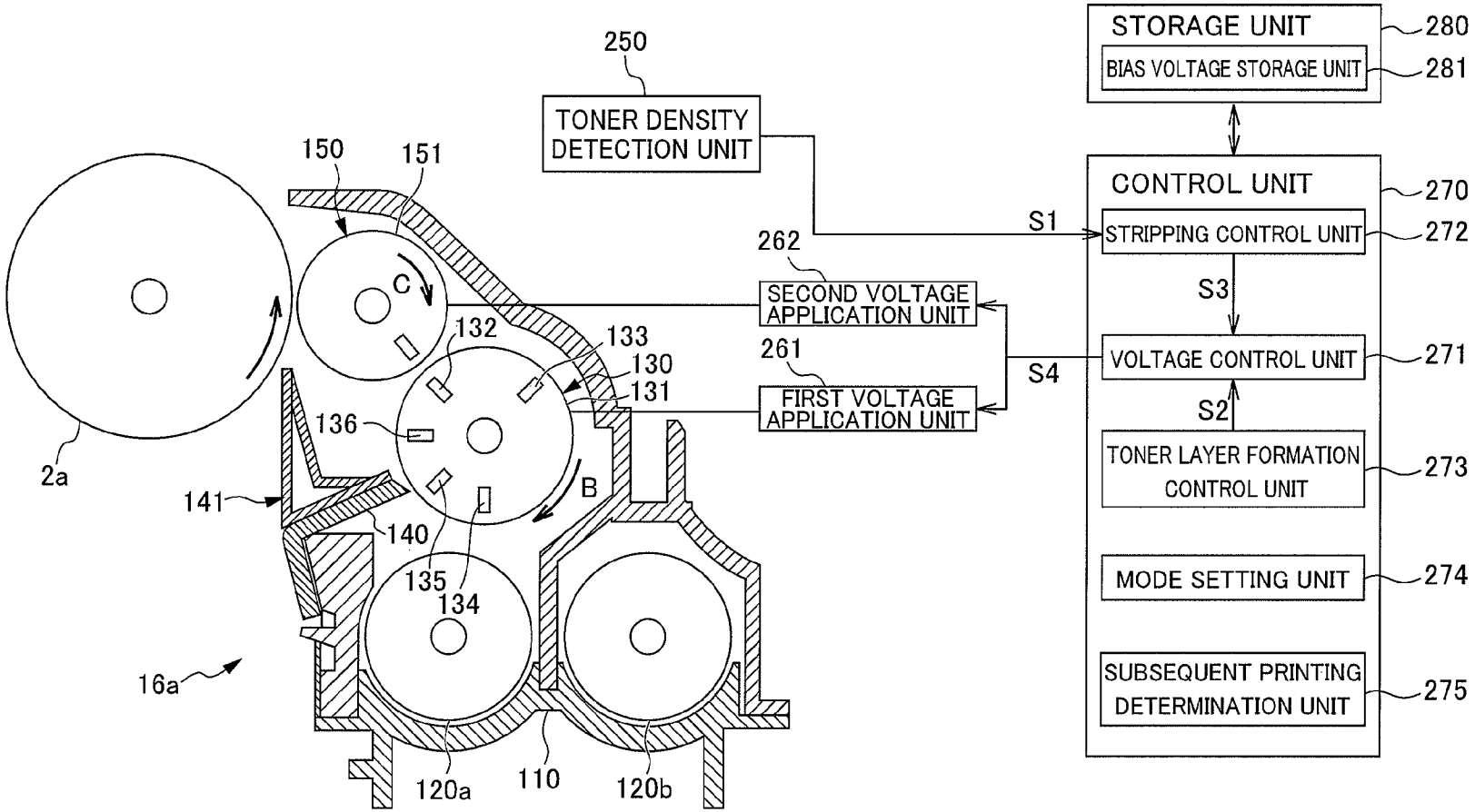
FIG. 2 is a functional block diagram showing control of a developing device 16*a;*
Figure 3:
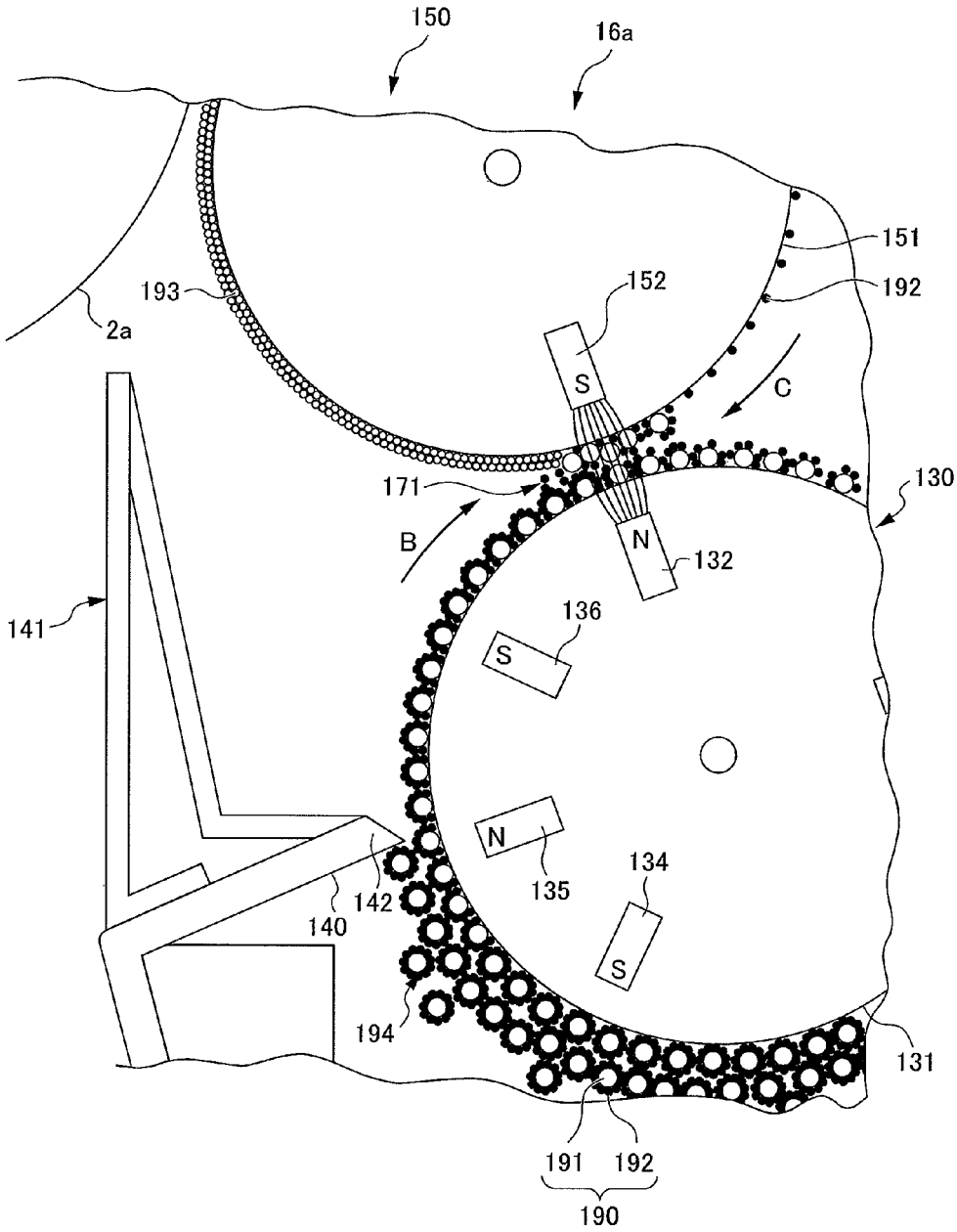
FIG. 3 is a diagram illustrating a state in which a toner layer 193 of a predetermined thickness is formed on a surface of a developing roller 150 in a toner layer formation mode TM.
Figure 4:
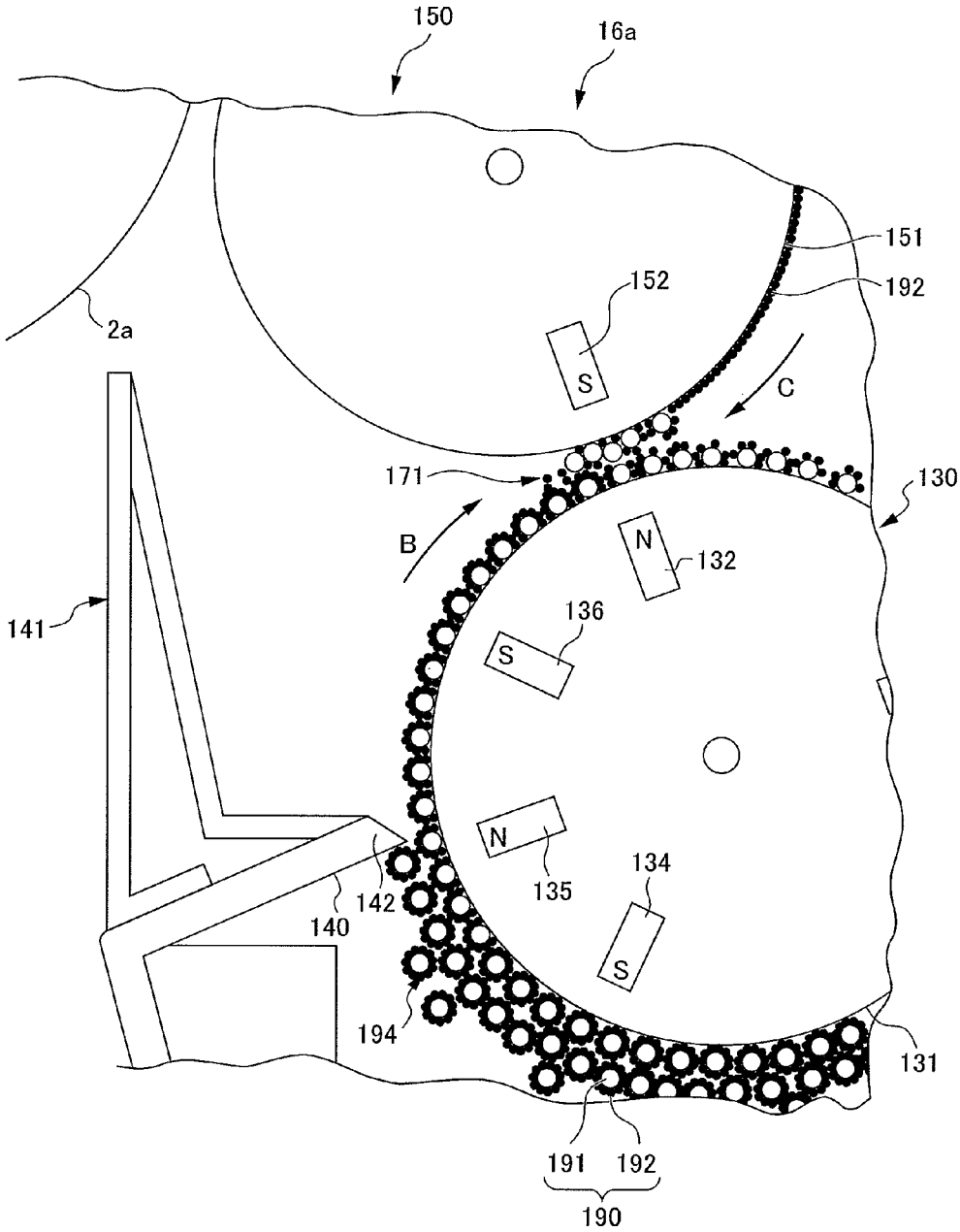
FIG. 4 is a diagram illustrating a state in which an entire amount of a toner 192 is successfully stripped from the surface of the developing roller 150 in a toner layer stripping mode HM.
Figure 5:
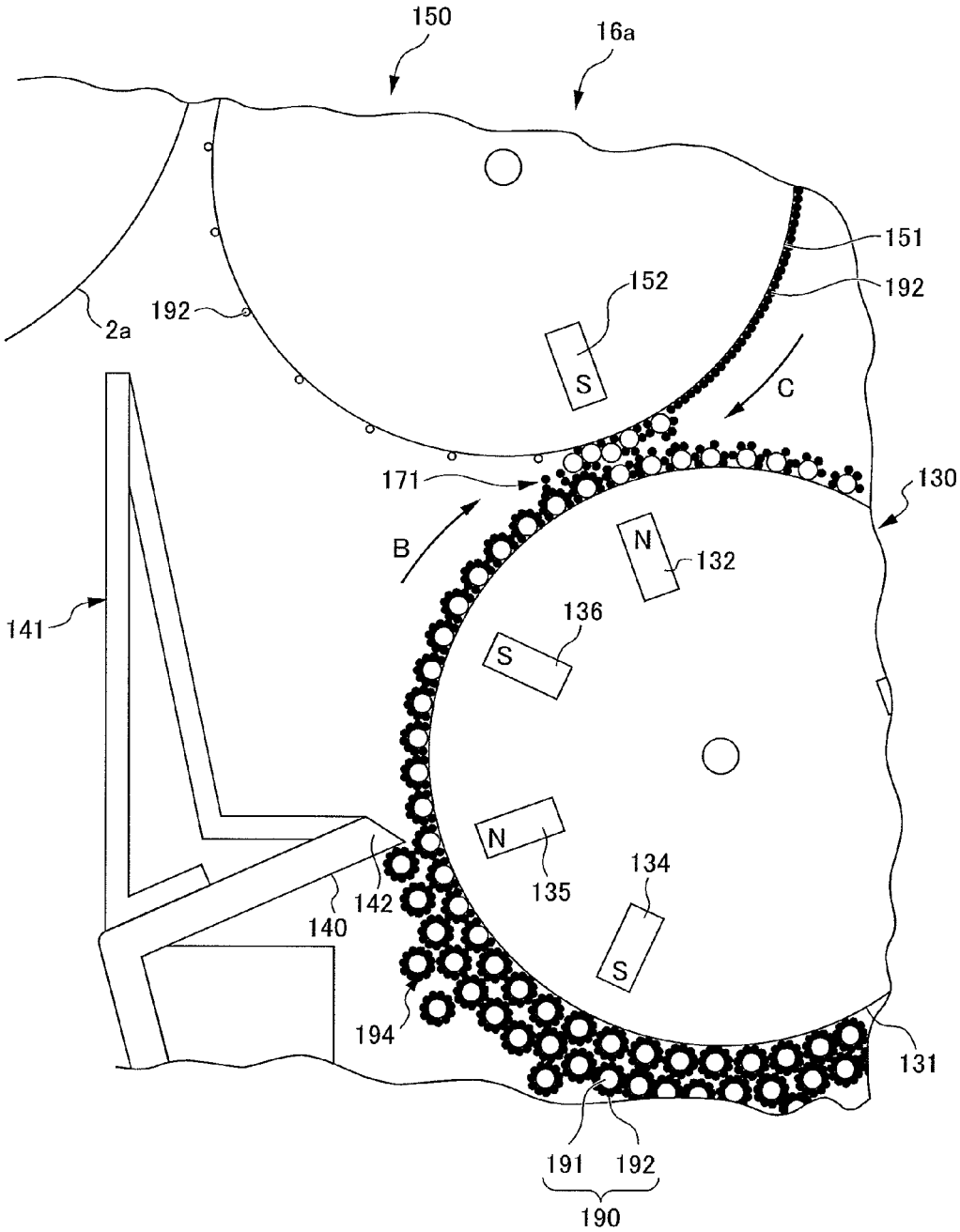
FIG. 5 is a diagram illustrating a state in which the toner 192 remains on the surface of the developing roller 150 in the toner layer, stripping mode HM.
Figure 6:
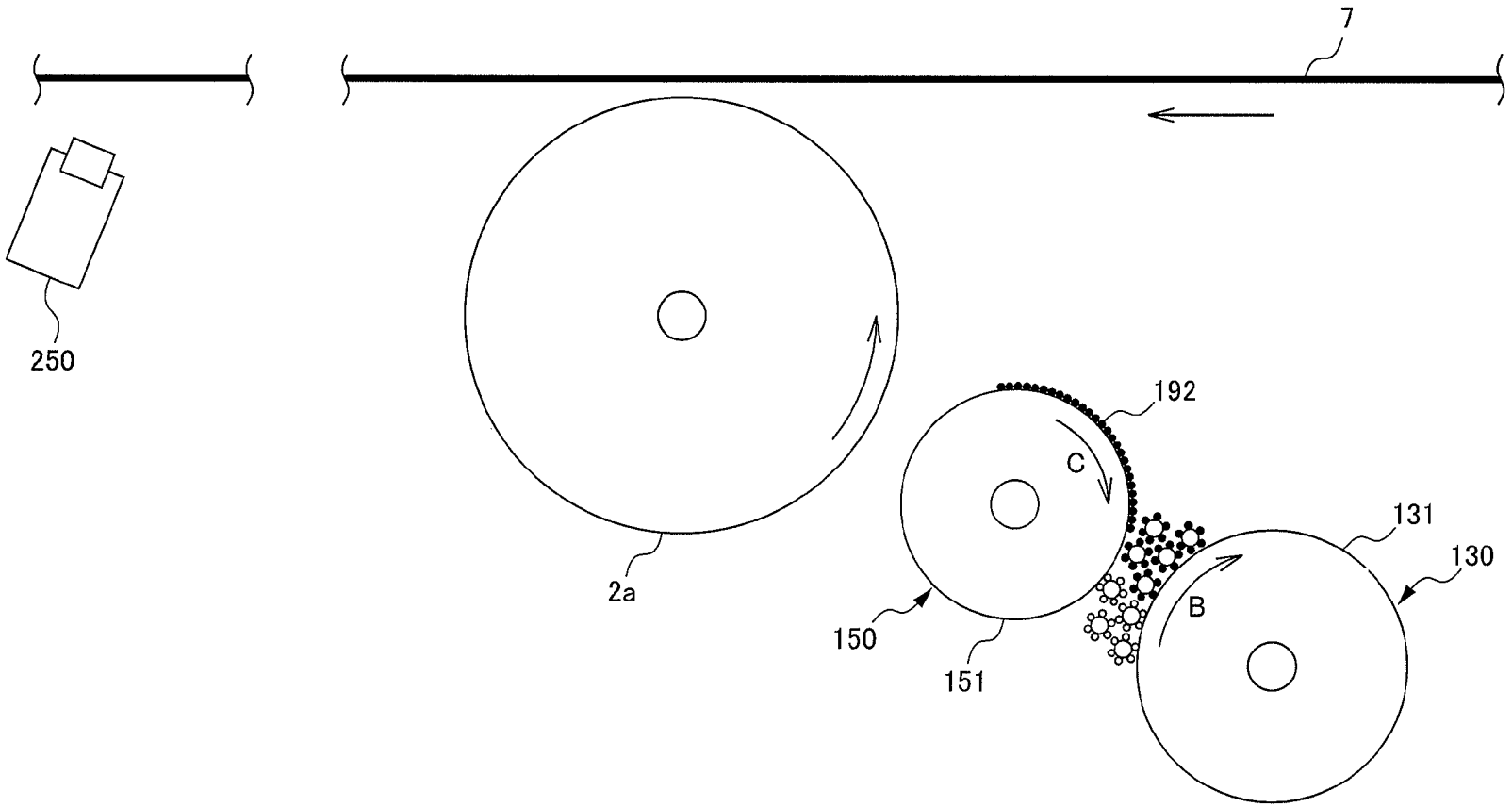
FIG. 6 is a diagram illustrating a state of a magnetic roller 130, the developing roller 150, a photosensitive drum 2*a*, and an intermediate transfer belt 7 in the toner layer stripping mode HM corresponding to FIG. 4.
Figure 7:
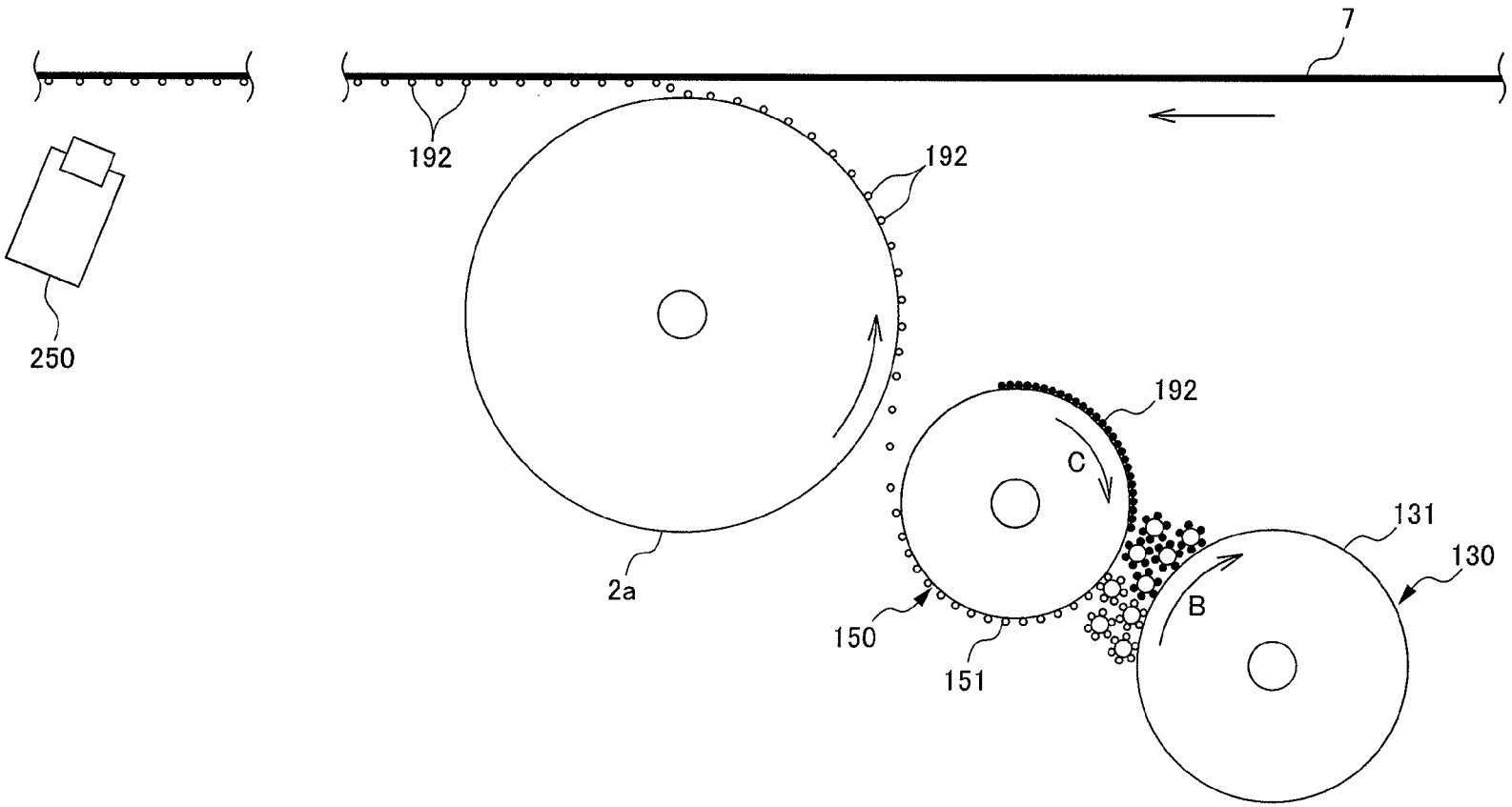
FIG. 7 is a diagram illustrating a state of the magnetic roller 130, the developing roller 150, the photosensitive drum 2*a*, and the intermediate transfer belt 7 in the toner layer stripping mode HM corresponding to FIG. 5.

FIG. 2 is a functional block diagram of control of the developing device 16*a*. FIG. 2 illustrates the developing device 16*a* and the photosensitive drum 2*a*. FIG. 3 is a diagram illustrating a state in which a toner layer 193 of a predetermined thickness is formed on a surface of a developing roller 150 in a toner layer formation mode TM. FIG. 4 is a diagram illustrating a state in which the entire amount of toner 192 is successfully stripped from the surface of the developing roller 150 in a toner layer stripping mode HM. FIG. 5 is a diagram illustrating a state in which the toner 192 remains on the surface of the developing roller 150 in the toner layer stripping mode HM. FIG. 6 is a diagram illustrating a state of a magnetic roller 130, the developing roller 150, the photosensitive drum 2*a*, and the intermediate transfer belt 7 in the toner layer stripping mode HM corresponding to FIG. 4. FIG. 7 is a diagram illustrating a state of the magnetic roller 130, the developing roller 150, the photosensitive drum 2*a*, and the intermediate transfer belt 7 in the toner layer stripping mode HM corresponding to FIG. 5.

As shown in FIGS. 2 to 5, the developing device 16*a* of the present embodiment includes a developer container 110, agitation rollers 120*a*, 120*b*, a magnetic roller 130, a layer thickness regulation blade 140, a developing roller 150, a voltage application unit, a control unit 270, and a storage unit 280. The developer container 110 stores a two-component developer 190 including toner 192 and a magnetic carrier 191. The agitation rollers 120*a*, 120*b* are disposed in the developer container 110. The magnetic roller 130 is disposed vertically above the agitation roller 120*a* and functions as a developer supporting rotator. The layer thickness regulation blade 140 is arranged close to the magnetic roller 130 on a side (left side in FIG. 2) of the magnetic roller 130. A cover member 141 is disposed vertically above the layer thickness regulation blade 140. The developing roller 150 is arranged opposite to the magnetic roller 130 and functions as a toner supporting rotator. The voltage application unit includes a first voltage application unit 261 and a second voltage application unit 262.

The toner 192 is supplied from a toner cartridge 5*a* (see FIG. 1) to the developer container 110 via a toner supply unit 6*a* (see FIG. 1).

The agitation rollers 120*a*, 120*b* agitate the two-component developer 190 accommodated in the developer container 110. In the two-component developer 190, static electricity is generated due to friction caused by agitation. In the present embodiment, the magnetic carrier 191 is negatively charged and the toner 192 is positively charged, for example. The toner 192 adheres to the magnetic carrier 191 through an electrostatic force.

The magnetic roller 130 is rotatable in a predetermined direction and includes a magnetic sleeve 131 composing a surface of the magnetic roller 130 and a plurality of magnetic roller pole members 132 to 136 arranged inside the magnetic sleeve 131.

The magnetic sleeve 131 is composed of a non-magnetic material and has a cylindrical shape. The magnetic sleeve 131 is rotationally driven in a direction of an arrow B shown in FIGS. 2 to 5. The first voltage application unit 261 applies a predetermined first bias voltage V1 to the magnetic sleeve 131.

As shown in FIGS. 2 to 5, the plurality of magnetic roller pole members 132 to 136 is fixed at predetermined circumferential intervals inside the magnetic sleeve 131.

The first magnetic roller pole member 132 is arranged to correspond to a closest part of the magnetic roller 130 with respect to a developing sleeve 151 (described later). The first magnetic roller pole member 132 is arranged such that an N pole is directed outward (toward a circumferential surface of the magnetic sleeve 131).

Other magnetic roller pole members 133 to 136 are fixed at predetermined intervals with respect to the first magnetic roller pole member 132 inside the magnetic sleeve 131. Each of the magnetic roller pole members 133, 134, 136 is arranged such that an S pole is directed outward (toward the circumferential surface of the magnetic sleeve 131). The magnetic roller pole member 135 is arranged such that an N pole is directed outward (toward the circumferential surface of the magnetic sleeve 131).

As shown in FIGS. 3 to 5, a part of the two-component developer 190 accommodated in the developer container 110 is retained on the surface of the magnetic sleeve 131 through magnetic forces applied by the magnetic roller pole member 132 to 136. The part of the two-component developer 190 retained on the surface of the magnetic roller 130 forms a developer layer (magnetic brush) 194.

The layer thickness regulation blade 140 regulates the thickness of the developer layer 194 formed on the surface of the magnetic roller 130. In other words, the layer thickness regulation blade 140 regulates the thickness (height) of the developer layer 194 formed of the two-component developer 190 retained by the magnetic roller 130, to thereby maintain the thickness of the developer layer 194 having passed through the layer thickness regulation blade 140. The layer thickness regulation blade 140 is composed of a plate-like member and disposed such that a tip 142 thereof is directed to and close to the surface of the magnetic sleeve 131. A predetermined gap is formed between the tip 142 of the layer thickness regulation blade 140 and the magnetic sleeve 131.

The cover member 141 is a member composing a part of a casing of the developing device 16*a*. The cover member 141 is disposed vertically above the layer thickness regulation blade 140 and on a side of the magnetic roller 130 (left side in FIG. 2). The cover member 141 prevents the toner 192 from scattering outside the developing device 16*a*.

The developing roller 150 is arranged to face the magnetic roller 130. The toner 192 migrated from the magnetic roller 130 forms a toner layer 193 on the surface of the developing roller 150. More specifically, the toner 192 migrates from the developer layer 194, of which thickness is regulated by the layer thickness regulation blade 140, to the surface of the developing roller 150, thereby forming the toner layer 193. The developing roller 150 includes a developing sleeve 151 composing the surface of the developing roller 150 and a developing roller pole member 152 disposed inside the developing sleeve 151.

The developing sleeve 151 is composed of a non-magnetic material and has a cylindrical shape. The developing sleeve 151 is rotationally driven. The moving direction of the developing sleeve 151 is opposite to the moving direction of the magnetic sleeve 131 (the direction of an arrow C in FIGS. 2 to 5) at a position at which the developing sleeve 151 and the magnetic sleeve 131 are arranged opposite to each other. The second voltage application unit 262 (described later) applies a predetermined second bias voltage V2 to the developing sleeve 151.

Inside the developing sleeve 151, the developing roller pole member 152 is fixed opposite to the first magnetic roller pole member 132. The developing roller pole member 152 is arranged to correspond to a closest part of the developing roller 150 with respect to the magnetic sleeve 131. In other words, the developing roller pole member 152 and the first magnetic roller pole member 132 are arranged to face each other across a region in which the developing sleeve 151 and the magnetic sleeve 131 are closest to each other.

An end portion of the developing roller pole member 152 directed to the first magnetic roller pole member 132 has a polarity opposite to that of an outer side of the first magnetic roller pole member 132. In other words, the developing roller pole member 152 is arranged such that an S pole is directed outward (toward a circumferential surface of the developing sleeve 151). As a result, a magnetic field 171 is generated between the first magnetic roller pole member 132 disposed inside the magnetic roller 130 and the developing roller magnetic member 152 disposed inside the developing roller 150. In a region in which the magnetic field 171 is generated between the magnetic roller 130 and the developing roller 150, the developer layer 194 rises from the surface of the magnetic roller 130 under the influence of the magnetic field 171, thereby forming the magnetic brush 194 that comes into contact with the developing roller 150.

As shown in FIGS. 6 and 7, the toner density detection unit 250 is disposed opposite to an outer surface of the intermediate transfer belt 7 to which a toner image is primarily transferred from the photosensitive drum 2*a* and more downstream than the photosensitive drum 2*a* in the conveying direction. The toner density detection unit 250 detects the density of the toner 192 that is conveyed while adhered to the outer surface of the intermediate transfer belt 7, in the toner layer stripping mode HM. The toner density detection unit 250 outputs a toner density detection signal S1 to a stripping control unit 272 (described later).

As shown in FIG. 2, the first voltage application unit 261 applies the first bias voltage V1 to the magnetic roller 130 in response to a control signal S4 sent from the voltage control unit 271 (described later).

The second voltage application unit 262 applies the second bias voltage V2 to the developing roller 150 in response to the control signal S4 sent from the voltage control unit 271 (described later).

The first bias voltage V1 and the second bias voltage V2 are each formed by superposing a direct voltage component (DC) with an alternating voltage component (Vpp). A bias voltage difference VB generates an electric field that causes the toner 192 to migrate between the magnetic roller 130 and the developing roller 150. The bias voltage difference VB represents a relationship between the first bias voltage V1 applied to the magnetic roller 130 and the second bias voltage V2 applied to the developing roller 150. The bias voltage difference VB (the relationship between the first bias voltage V1 and the second bias voltage V2) is a voltage difference between the first bias voltage V1 and the second bias voltage V2, using the second bias voltage V2 as a reference.

As shown in FIG. 2, the control unit 270 includes the voltage control unit 271, the stripping control unit 272, a toner layer formation control unit 273, a mode setting unit 274, and a subsequent printing determination unit 275.

The voltage control unit 271 outputs the control signal S4 to the first voltage application unit 261 and the second voltage application unit 262 in response to the control signal S2 sent from the toner layer formation control unit 273 or the control signal S3 sent from the stripping control unit 272 (described later).

The subsequent printing determination unit 275 determines whether an instruction of subsequent printing has been given to the copy machine 1.

The mode setting unit 274 selectively sets (switches between) the toner layer formation mode TM and the toner layer stripping mode HM.

The toner layer formation mode TM is an operation mode in which the toner layer 193 of a predetermined thickness is formed on the surface of the developing roller 150 when the developing device 16*a* performs development. More specifically, the mode setting unit 274 sets the toner layer formation mode TM, in response to turning on the copy machine 1. In addition, the mode setting unit 274 switches from the toner layer stripping mode HM to the toner layer formation mode TM, when the toner layer stripping mode HM is finished.

The toner layer stripping mode HM is an operation mode in which the toner 192 composing the toner layer 193 formed on the surface of the developing roller 150 is stripped during a plurality of rotations of the developing roller 150. More specifically, the mode setting unit 274 can switch from the toner layer formation mode TM to the toner layer stripping mode HM while no toner image is being formed on the photosensitive drum 2*a* by the developing device 16*a*.

The toner layer formation control unit 273 instructs the voltage control unit 271 to control the bias voltage difference VB to the first voltage difference VB1 in the toner layer formation mode TM. As a result of controlling the bias voltage difference VB to the first voltage difference VB1, an electric field that migrates the toner 192 is generated between the magnetic roller 130 and the developing roller 150.

As shown in FIG. 4, in a predetermined time period since the bias voltage difference VB has been set to the first voltage difference VB1, a state of equilibrium occurs, in which the toner 192 does not migrate between the magnetic roller 130 and the developing roller 150. The state of equilibrium associated with the migration of the toner 192 represents a state in which the migration of the toner 192 from the magnetic roller 130 to the developing roller 150 and the migration of the toner 192 from the developing roller 150 to the magnetic roller 130 are balanced each other.

If the bias voltage difference VB changes from the state of equilibrium, the toner 192 can migrate from the magnetic roller 130 to the developing roller 150, and vice versa. For example, when the bias voltage difference VB is changed from the first voltage difference VB1 of the state of equilibrium to a greater bias voltage difference, the toner 192 positively charged migrates from the developing roller 150 to the magnetic roller 130. On the other hand, when the bias voltage difference VB is changed from the first voltage difference VB1 of the state of equilibrium to a smaller bias voltage difference, the toner 192 positively charged migrates from the magnetic roller 130 to the developing roller 150.

As shown in FIG. 2, the toner layer formation control unit 273 accesses to the storage unit 280 (described later) to obtain voltage information regarding the first voltage difference VB1 stored in the storage unit 280. The toner layer formation control unit 273 sends an instruction to the voltage control unit 271 based on the voltage information stored in the storage unit 280. More specifically, the toner layer formation control unit 273 outputs the control signal S2 to the voltage control unit 271 to set the bias voltage difference VB to the first voltage difference VB1 in the toner layer formation mode TM. In this manner, the toner layer 193 of the predetermined thickness is formed on the surface of the developing roller 150.

As shown in FIG. 2, the stripping control unit 272 instructs the voltage control unit 271 to set the bias voltage difference VB to the second voltage difference VB2 in the toner layer stripping mode HM.

The toner layer formation control unit 273 refers to the storage unit 280 (described later) to obtain voltage information regarding the second voltage difference VB2 stored in the storage unit 280. The stripping control unit 272 instructs the voltage control unit 271 to strip the toner layer 193 formed on the surface of the developing roller 150 during a plurality of rotations of the developing roller 150.

More specifically, the stripping control unit 272 outputs the control signal S3 to the voltage control unit 271 based on the voltage information stored in the storage unit 280 in the toner layer stripping mode HM, such that the bias voltage difference VB changes from the first voltage difference VB1 to the second voltage difference VB2 at a time of first rotation.

The second voltage difference VB2 is a bias voltage difference VB for migrating the toner 192 from the toner layer 193 to the magnetic roller 130 at a time of first rotation, when the toner layer 193 is formed on the surface of the developing roller 150. More specifically, when the toner 192 is positively charged, the second voltage difference VB2 is greater than the first voltage difference VB1.

More specifically, the stripping control unit 272 instructs the voltage control unit 271 to change the bias voltage difference VB to the second voltage difference VB2 that is greater than the first voltage difference VB1 at a time of first rotation of the developing roller 150 in the toner layer stripping mode HM. If the second voltage difference VB2 is set, an electric field for migrating the toner 192 from the developing roller 150 to the magnetic roller 130 is generated.

In the present embodiment, as shown in FIG. 4, if the bias voltage difference VB is changed from the first voltage difference VB1 to the second voltage difference VB2, the toner 192 migrates from the toner layer 193 formed on the developing roller 150 to the magnetic roller 130. More specifically, the toner 192 composing the toner layer 193 formed on the developing roller 150 is transferred from the developing roller 150 to the magnetic roller 130 by the magnetic brush 194 under an influence of the electric field due to the second voltage difference VB2.

When the second voltage difference VB2 is set to an optimal value, the entire amount of the toner 192 composing the toner layer 193 formed on the surface of the developing roller 150 is stripped, as shown in FIG. 6, in the toner layer stripping mode HM. In other words, since stripping of the toner is successfully performed, it will not occur that the toner 192 flies from the developing roller 150 to the surface of the photosensitive drum 2*a* and is transferred from the photosensitive drum 2*a* to adhere to the outer surface of the intermediate transfer belt 7.

In addition, when the second voltage difference VB2 is not set to an optimal value, a part of the toner 192 remains on the surface of the developing roller 150 in the toner layer stripping mode HM, as shown in FIG. 5. In other words, stripping of the toner is not successfully performed to be in an abnormal state (failure). In such a case, the stripping control unit 272 causes the toner 192 remaining on the surface of the developing roller 150 to fly to the surface of the photosensitive drum 2*a* in the toner layer stripping mode HM, as shown in FIG. 7. The toner 192 is transferred from the photosensitive drum 2*a* to adhere to the outer surface of the intermediate transfer belt 7. The density of the adhered toner 192 is detected by the toner density detection unit 250.

As shown in FIG. 2, the toner density detection signal S1 detected by the toner density detection unit 250 is entered into the stripping control unit 272. The stripping control unit 272 outputs the control signal S3 for adjusting the second voltage difference VB2 to the voltage control unit 271, such that the toner density decreases based on the toner density detection signal S1 sent from the toner density detection unit 250.

More specifically, the second voltage difference VB2 is adjusted (increased) stepwise to determine an optimal setting value of the second voltage difference VB2, such that the toner density detected by the toner density detection unit 250 gradually decreases (such that no toner 192 remains on the surface of the developing roller 150) in the toner layer stripping mode HM. The second voltage difference VB2 is adjusted by changing only the alternating voltage component (Vpp) of the first bias voltage V1. And, the optimal setting value for the second voltage difference VB2 is stored in a bias voltage storage unit 281 (described later).

As shown in FIG. 2, the storage unit 280 includes the bias voltage storage unit 281.

The bias voltage storage unit 281 stores voltage information regarding the first bias voltage V1 and the second bias voltage V2 for setting the bias voltage difference VB to the first voltage difference VB1 and the second voltage difference VB2.

In addition, the bias voltage storage unit 281 also updates and stores the voltage information regarding the first bias voltage V1 corresponding to the optimal setting value of the second bias voltage VB2 adjusted and determined based on the toner density detection signal S1 in the toner layer stripping mode HM.

Next, specific operation of the developing device 16*a* according to the present embodiment is described hereinafter with reference to FIGS. 2 to 7.

First, when a user turns on the copy machine 1, the mode setting unit 274 sets the copy machine 1 to the toner layer formation mode TM. The toner layer formation mode TM is an operation mode in which the toner layer 193 of a predetermined thickness is formed on the surface of the developing roller 150 while the developing device 16*a* is performing development.

After the toner layer formation mode TM is set by the mode setting unit 274, the two-component developer 190 is first agitated by the agitation rollers 120*a*, 120*b*, as shown in FIGS. 2 and 3. In the two-component developer 190 thus agitated, static electricity is generated due to friction. The magnetic carrier 191 is negatively charged and the toner 192 is positively charged. The toner 192 adheres to the magnetic carrier 191 through an electrostatic force.

As shown in FIG. 3, the two-component developer 190 is retained on the surface of the magnetic roller 130 rotating in a rotational direction B due to a magnetic force applied by the magnetic roller pole members 132 to 136 provided inside the magnetic sleeve 131. The developer layer 194 is formed on the surface of the magnetic roller 130 by magnetic forces applied by the plurality of magnetic roller pole members 134 to 136.

The developer layer 194 formed on the surface of the magnetic roller 130 rotationally moves following rotation of the magnetic sleeve 131 and is regulated to a predetermined layer thickness by coming into contact with the layer thickness regulating blade 140.

The developer layer 194 regulated to the predetermined layer thickness by the layer thickness regulating blade 140 moves to a vicinity at which the magnetic roller 130 and the developing roller 150 are opposite to each other, and then reaches a region in which the magnetic field 171 is generated. In this region, the developer layer 194 rises under the influence of the magnetic field 171, thereby forming the magnetic brush 194 to come into contact with the developing roller 150.

The toner layer formation control unit 273 then instructs the voltage control unit 271 to set the bias voltage difference VB to the first voltage difference VB1. As a result, as shown in FIGS. 2 and 3, the positively charged toner 192 composing the two-component developer 190 retained on the surface of the magnetic roller 130 is transferred to the developing roller 150 by the magnetic brush 194 under the influence of the electric field, with the bias voltage difference VB being set to the first voltage difference VB1. In this manner, the toner layer 193 is formed on the surface of the developing roller 150.

As shown in FIG. 3, in a predetermined time period since the bias voltage difference VB has been set to the first voltage difference VB1, the toner 192 reaches a state of equilibrium in which the toner 192 does not migrate between the magnetic roller 130 and the developing roller 150. Accordingly, the toner layer 193 is desirably formed on the surface of the developing roller 150.

Next, a user instructs the copy machine 1 to form (print) an image on a sheet of paper T. The user's printing instruction to the copy machine 1 may either be an instruction of printing an image on a sheet of paper T or an instruction of printing the image successively on a plurality of sheets of paper T.

When the instruction for printing the image on a sheet of paper T is executed, the copy machine 1 starts printing of the image on the sheet of paper T.

The developing device 16*a* develops an electrostatic latent image formed on the photosensitive drum 2 using the toner layer 193 formed on the surface of the developing roller 150.

More specifically, the surface of the developing roller 150 on which the toner layer 193 is formed faces a surface of the photosensitive drum 2*a*, and the electrostatic latent image is developed by the voltage difference between the developing roller 150 and the photosensitive drum 2*a*. In other words, the electrostatic latent image is formed on the surface of the photosensitive drum 2*a* and a toner image is formed on the electrostatic latent image by the toner supplied from the toner layer 193 of the developing device 16*a*.

Subsequently, as shown in FIG. 1, the toner image developed on the photosensitive drum 2*a* is sequentially transferred onto the intermediate transfer belt 7. The toner image primarily transferred to the intermediate transfer belt 7 is secondarily transferred to the sheet of paper T by the secondary transfer roller 8. The sheet of paper T to which the toner image is secondarily transferred is conveyed to the fusing unit 9 and the toner is fused onto the sheet of paper T by the fusing unit 9.

Subsequently, the sheet of paper T is fed to the first discharge portion 50*a* via the third paper path L3 and discharged from the first discharge portion 50*a* to the discharged paper collection part M1. Printing on the sheet of paper T by the copy machine 1 is thus completed.

The subsequent printing determination unit 275 determines whether an instruction of subsequent printing has been given to the copy machine 1. If the subsequent printing determination unit 275 determines that an instruction of subsequent printing has been given, the mode setting unit 274 maintains the toner layer formation mode TM for performing successive formation of a toner image on the photosensitive drum 2*a*. If the subsequent printing determination unit 275 determines that the instruction of subsequent printing has not been given, the developing device 16*a* does not perform successive formation of a toner image on the photosensitive drum 2*a*. Accordingly, the mode setting unit 274 switches the mode from the toner layer formation mode TM to the toner layer stripping mode HM.

The toner layer stripping mode HM is an operation mode in which the toner 192 composing the toner layer 193 formed on the surface of the developing roller 150 is stripped during a plurality of rotations of the developing roller 150. More specifically, the mode setting unit 274 can switch the mode from the toner layer formation mode TM to the toner layer stripping mode HM when no toner image is formed on the photosensitive drum 2*a* by the developing device 16*a*.

As shown in FIG. 2, the stripping control unit 272 outputs the control signal S3 to the voltage control unit 271 based on the voltage information obtained from the storage unit 280 at a time of first rotation of the developing roller 150, such that the bias voltage difference VB is changed from the first voltage difference VB1 to the second voltage difference VB2, in the toner layer stripping mode HM.

More specifically, the stripping control unit 272 instructs the voltage control unit 271 at a time of first rotation of the developing roller 150 to change the bias voltage difference VB to the second voltage difference VB2 that is greater than the first voltage difference VB1, when the toner layer 193 is formed on the surface of the developing roller 150.

As a result, as shown in FIG. 4, the toner 192 composing the toner layer 193 formed on the developing roller 150 is transferred from the developing roller 150 to the magnetic roller 130 by the magnetic brush 194 under an influence of the electric field generated when the bias voltage difference VB is equal to the second voltage difference VB2.

In other words, when the second voltage difference VB2 is set to an optimal value, the entire amount of the toner 192 composing the toner layer 193 formed on the surface of the developing roller 150 is successfully stripped in the toner layer stripping mode HM, as shown in FIG. 4. In this manner, as shown in FIG. 6, it will not occur that the toner 192 flies from the developing roller 150 to the surface of the photosensitive drum 2*a* and is transferred from the photosensitive drum 2*a* to adhere to the outer surface of the intermediate transfer belt 7.

As shown in FIG. 4, the developer 190 including the toner 192 stripped (migrated) from the developing roller 150 is conveyed to a portion where the magnetic roller pole members that are homopolar to the toner 192 are placed, following rotation of the magnetic roller 130. The developer 190 including the toner 192 is separated from the surface of the magnetic roller 130 to drop into the developer container 110 by a magnetic force generated at such a portion. The developer 190 including the toner 192 having dropped inside the developer container 110 is agitated and electrically charged by the agitation rollers 120*a*, 120*b*.

Figure 8:
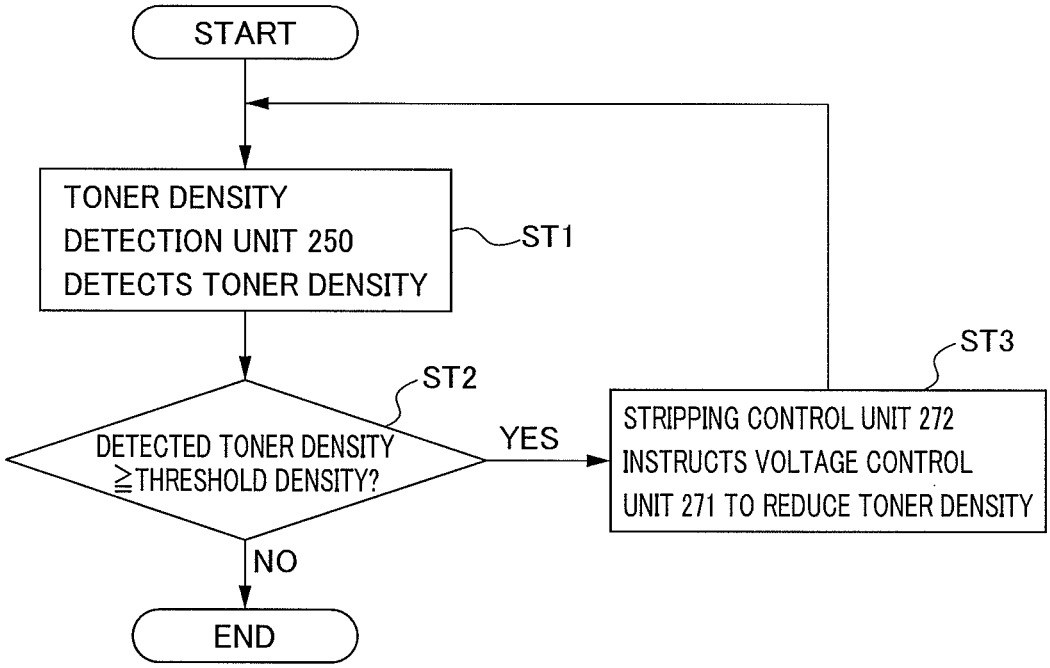
FIG. 8 is a flow chart showing an optimization process of the toner layer stripping mode.

On the other hand, when the second voltage difference VB2 is not set to an optimal value, the toner 192 composing the toner layer 193 formed on the surface of the developing roller 150 is not fully stripped and remains thereon in the toner layer stripping mode HM, as shown in FIG. 5. In other words, stripping of the toner is abnormal (failure). A control flow for optimizing process in the toner layer stripping mode to cope with such an abnormal occasion is described with reference to FIG. 8. FIG. 8 is a flow chart showing an optimization process of the toner layer stripping mode.

When stripping of the toner is abnormal (failure), the toner 192 that remains on the surface of the developing roller 150 flies to the surface of the photosensitive drum 2*a*, and is conveyed from the photosensitive drum 2*a* to adhere to an outer surface of the intermediate transfer belt 7, as shown in FIG. 7.

As shown in FIG. 8, the density of the toner 192 adhering to the outer surface of the intermediate transfer belt 7 is detected by the toner density detection unit 250 in Step ST1. The toner density detection signal S1 detected by the toner density detection unit 250 is entered into the stripping control unit 272.

In Step ST2, the stripping control unit 272 determines whether the detected density is greater than a predetermined threshold of density. If the detected density is equal to or greater than the predetermined threshold of density (YES), processing advances to Step ST3. If the detected density is smaller than the predetermined threshold of density (NO), the processing terminates.

In Step ST3, the stripping control unit 272 outputs the control signal S3 for adjusting the second voltage difference VB2 to the voltage control unit 271 in order to reduce the toner density based on the toner density detection signal S1 sent from the toner density detection unit 250. More specifically, the second voltage difference VB2 is adjusted (increased) stepwise to determine an optimal setting value of the second voltage difference VB2, such that the toner density detected by the toner density detection unit 250 gradually decreases (such that no toner 192 remains on the surface of the developing roller 150) in the toner layer stripping mode HM.

The second voltage difference VB2 is adjusted by changing only the alternating voltage component (Vpp) of the first bias voltage V1. The determined optimal setting value for the second voltage difference VB2 is stored in the bias voltage storage unit 281 as the updated voltage information regarding the first bias voltage V1 in the toner layer stripping mode HM.

After Step ST3, the processing returns to Step ST1 and repeats.

Upon completion of the toner layer stripping mode HM, the mode setting unit 274 switches the operation mode from the toner layer stripping mode HM to the toner layer formation mode TM.

The toner layer formation control unit 273 instructs the voltage control unit 271 to set the bias voltage difference VB to the first voltage difference VB1 in the toner layer formation mode TM. Accordingly, a new toner layer 193 is formed on the developing roller 150 which has been stripped of the toner 192.

As described above, the developing device 16*a* can uniformly form the new toner layer 193 after stripping of the toner layer 193 formed on the developing roller 150.

Accordingly, the developing device 16*a* can suppress the reduced density of a toner image and generation of image defect such as developing ghost due to the accumulation of the toner 192 remaining on the surface of the developing roller 150.

In addition, the developing device 16*a* can determine an optimal setting value of the bias voltage difference for stripping performance of the toner 192 according to the size of a gap between the magnetic roller 130 and the developing roller 150 of the developing device 16*a*, temperature, humidity and the like in the toner layer stripping mode HM.

As a result, it is possible to improve developing ghost and to prevent blockage of the nip portion with the developer and leakage due to an excessive bias voltage, regardless of a variation in accuracy of an individual copy machine 1 including the developing device 16*a* and a variation in environmental conditions of a site for installing the copy machine 1. In this manner, it is possible to form an image of desirable quality.

The copy machine 1 of the present embodiment provides, for example, the following effects.

The copy machine 1 of the present embodiment includes the developing device 16*a* with the toner layer formation control unit 273 and the stripping control unit 272, and the toner density detection unit 250. The toner layer formation control unit 273 instructs the voltage control unit 271 to set the bias voltage difference VB to the first voltage difference VB1 in the toner layer formation mode TM. In the toner layer stripping mode HM in which the toner layer 193 formed on the surface of the developing roller 150 is stripped during a plurality of rotations of the developing roller 150, the stripping control unit 272 instructs the voltage control unit 271 to set the bias voltage difference VB to the second voltage difference VB2, at which a substantially entire amount of the toner 192 in the toner layer 193 formed on the developing roller 150 is transferred to the magnetic roller 130. The toner density detection unit 250 detects the toner density of the intermediate transfer belt 7 to which the toner image is primarily transferred from the photosensitive drum 2*a*. When the toner 192 remains on the surface of the developing roller 150, the stripping control unit 272 outputs to the voltage control unit 271 an instruction for adjusting the second voltage difference VB2, at which the residual toner flies to the surface of the photosensitive drum 2*a* and the toner density decreases according to the toner density detected by the toner density detection unit 250, in the toner layer stripping mode HM.

According to the abovementioned embodiment, there is no need to arrange a plurality of magnetic rollers inside the image forming apparatus, and to apply bias voltages of different values to these magnetic rollers. As a result, it is possible to simplify the mechanism and reduce the image forming apparatus in size. Simultaneously, it is possible to determine the second voltage difference VB2 that is optimal for successfully stripping the entire amount of the toner 192 from the toner layer 193 formed on the surface of the developing roller 150 in the toner layer stripping mode HM.

Accordingly, it is possible to provide a high toner stripping performance to allow formation of a uniform toner layer 193 on the surface of the developing roller 150 for a subsequent development, regardless of a variation in accuracy of components of the copy machine 1 including the developing device 16*a* and a variation in environmental conditions of a site for installing the copy machine 1. Accordingly, it is possible to improve developing ghost and to prevent blockage of the nip portion with the developer and leakage due to excessive bias voltage, so that it is possible to constantly form an image of a desirable quality.

In addition, according to the present embodiment, the stripping control unit 272 adjusts stepwise the second voltage difference VB2 to determine the setting value (optimal value) of the second voltage difference VB2, such that the toner density detected by the toner density detection unit 250 gradually decreases in the toner layer stripping mode HM.

Accordingly, it is possible not only to decrease a load of the stripping control unit 272 regarding the instruction given to the voltage control unit 271, but also to prevent excessive adjustment of the second voltage difference VB2. Accordingly, it is possible to suppress an occurrence of hunting due to excessive voltage adjustment and enable quick determination of the optimal setting value of the second voltage difference VB2.

Furthermore, according to the present embodiment, the stripping control unit 272 instructs the voltage control unit 271 to change only the alternating voltage component (Vpp) of the first bias voltage V1 to generate the second voltage difference VB2 in the toner layer stripping mode HM.

Accordingly, it is only necessary for the stripping control unit 272 to instruct the voltage control unit 271 to change the Vpp component, with the direct voltage component of the first bias voltage V1 being unchanged. As a result, the stripping control unit 272 can more easily control the voltage control unit 271 and can more efficiently determine the optimal setting value of the second voltage difference VB2.

Example

The present disclosure is described more in detail with Examples of the present disclosure and Comparative Examples. It should be noted that the present disclosure is not limited to the following Examples.

In Examples and Comparative Examples, a multifunction peripheral manufactured by Kyocera Mita Corporation (product name: TASKalfa 5550ci) was subjected to testing. The multifunction peripheral was controlled to switch to the toner layer stripping mode HM immediately after completion of printing of each color and the toner 192 was stripped (separated) from the toner layer 193 formed on the surface of the developing roller 150.

More specifically, in Examples, the toner layer 193 was formed on the surface of the developing roller 150 in the toner layer formation mode TM in which the bias voltage difference VB was set to the first voltage difference VB1.

Subsequently, the operation mode was switched from the toner layer formation mode TM to the toner layer stripping mode HM. After the toner layer 193 was formed on an entire circumferential surface of the developing roller 150 (corresponding to a single rotation of the developing roller 150), the bias voltage difference was controlled such that the toner 192 was stripped from the toner layer 193 and conveyed to adhere to the intermediate transfer belt 7 in the toner layer stripping mode HM. Subsequently, in the toner layer stripping mode HM, the toner density detection unit 250 detected the density of the toner 192 adhering to the intermediate transfer belt 7, and an optimal second voltage difference VB2 was determined by adjusting the second voltage difference VB2 according to the detected density.

Conditions for the bias voltages in the toner layer stripping mode HM were as shown below.

First bias voltage V1 applied to the magnetic roller 130: DC=100 V, Vpp=2.9 kV Second bias voltage V2 applied to the developing roller 150: DC=50 V Surface potential of photosensitive drum 2*a*: 20 V Voltage of the intermediate transfer belt 7: −1000 V After determining the optimal value of the second voltage difference VB2 by the abovementioned control, an image sample was output. In addition, a gap (nip portion) between the magnetic roller 130 and the developing roller 150 was stepwise changed in six values from 0.30 to 0.20 mm. Under these conditions, it was investigated whether image defect (ghost) occurred and whether failure such as leakage and blockage with developer during operation of the developing device 16*a* occurred.

In Comparative Examples 1 to 3, the control was not performed as in Examples. That is to say, the bias voltage in the toner layer stripping mode HM was fixed to Vpp=2.40 kV, 2.25 kV, and 2.00 kV, while the gap (nip portion) between the magnetic roller 130 and the developing roller 150 was stepwise changed in 6 values similar to Examples. Under these conditions, an image sample was output and it was investigated whether image defect occurred and whether failure such as leakage and blockage with developer during operation of the developing device 16*a* occurred.

Results of the investigation for Examples and Comparative Examples 1 to 3 are shown in Table 1. Symbols used in Table 1 represent the following.

Circle: Neither image defect nor operation failure occurred.

X: Image defect or operation failure occurred.

TABLE 1

| | Gap between magnetic roller and developing roller (mm) | | | | | |
|---|---|---|---|---|---|---|
| | 0.30 | 0.28 | 0.26 | 0.24 | 0.22 | 0.20 |
| EXAMPLE | | | | | | |
| Vpp of magnetic roller after control (kV) | 2.40 | 2.30 | 2.25 | 2.16 | 2.10 | 2.00 |
| Ghost | ○ | ○ | ○ | ○ | ○ | ○ |
| Leakage | ○ | ○ | ○ | ○ | ○ | ○ |
| Developing agent jam | ○ | ○ | ○ | ○ | ○ | ○ |
| COMPARATIVE EXAMPLE 1 | | | | | | |
| Vpp of magnetic roller after control (kV) | 2.40 | | | | | |
| Ghost | ○ | ○ | ○ | ○ | ○ | ○ |
| Leakage | ○ | ○ | x | x | x | x |
| Developing agent jam | ○ | ○ | ○ | x | x | x |
| COMPARATIVE EXAMPLE 2 | | | | | | |
| Vpp of magnetic roller after control (kV) | 2.25 | | | | | |
| Ghost | x | x | ○ | ○ | ○ | ○ |
| Leakage | ○ | ○ | ○ | x | x | x |
| Developing agent jam | ○ | ○ | ○ | ○ | x | x |
| COMPARATIVE EXAMPLE 3 | | | | | | |
| Vpp of magnetic roller after control (kV) | 2.00 | | | | | |
| Ghost | x | x | x | x | x | ○ |
| Leakage | ○ | ○ | ○ | ○ | ○ | ○ |
| Developing agent jam | ○ | ○ | ○ | ○ | ○ | ○ |

As is obvious from the results of the investigation shown in Table 1 for Examples, in which the toner density detection unit 250 detects the density of the toner 192 adhering to the intermediate transfer belt 7 and the optimal second voltage difference VB2 is determined by adjusting the second voltage difference VB2 according to the detected density in the toner layer stripping mode HM, it is demonstrated that even if there are variations in the size of the gap and environmental conditions such as temperature and humidity, an image defect such as ghost and an operation failure such as blockage of the gap with developer and leakage due to excessive voltage did not occur.

On the other hand, in Comparative Examples in which the control performed in Examples was not performed and the second voltage difference VB2 was fixed, it is verified that an image defect such as ghost and an operation failure such as blockage of the gap with developer and leakage occurred, which were caused by variations in the size of the gap and environmental conditions such as temperature and humidity.

A preferred embodiment of the present disclosure has been described above. However, the present disclosure is not limited thereto and may be carried out in various modes.

In the above embodiment, a case in which the toner 192 is positively charged has been described. However, the present disclosure is not limited thereto. The toner 192 may also be negatively charged. More specifically, in the above embodiment, a case in which the positively charged toner 192 is used has been described. When the positively charged toner 192 is used, the second voltage difference VB2 is a bias voltage difference VB greater than the first voltage difference VB1.

On the other hand, when the negatively charged toner 192 is used, the second voltage difference VB2 should be a bias voltage difference VB smaller than the first voltage difference VB1. In this manner, it is possible to provide effects similar to those of the above embodiment even if the negatively charged toner 192 is adopted.

Except for the feature described above, a configuration, operation and effect in a case of using the negatively charged toner 192 are similar to those in a case of using the positively charged toner 192.

The above embodiment is configured such that the operation mode is switched to the toner layer stripping mode HM when no instruction is given to a subsequent printing job (after completion of successive printing of a plurality of sheets of paper T). However, the present disclosure is not limited thereto. The present disclosure may also be configured such that the operation mode is switched to the toner layer stripping mode HM even if successive printing on a plurality of sheets of paper T is in progress. For example, it may be that a predetermined interval (time period) is provided between two successive sheets of paper T to allow switching to the toner layer stripping mode HM each time a predetermined number of sheets of paper T have been printed.

In addition, in the above embodiment, a configuration has been described in which: the operation mode is switched to the toner layer stripping mode HM when no instruction is given to a subsequent printing job (after completion of successive printing of a plurality of sheets of paper T); when the stripping is failed, the toner density detection unit 250 detects the density of the toner 192 adhering to the intermediate transfer belt 7; and the optimal second voltage difference VB2 is determined by adjusting the second voltage difference VB2 according to the detected toner density. However, the present disclosure is not limited thereto. Alternatively, it may be that the operation mode is controlled to switch to the toner layer stripping mode HM and the second voltage difference VB2 is adjusted in an idling state immediately after startup of the copy machine 1.

In the toner layer stripping mode HM in the idling state, the stripping control unit 272 sets the bias voltage difference VB to the first voltage difference VB1 to form the toner layer 193 on the surface of the developing roller 150, and then changes the bias voltage difference VB to the second voltage difference VB2. In this connection, the toner density detection unit 250 detects the density of the toner 192 if the toner 192 flies to adhere to the outer surface of the intermediate transfer belt 7 via the photosensitive drum 2*a* while the developing roller 150 rotates at least one revolution, after a position on the surface of the developing roller 150 having been opposite to the surface of the magnetic roller 130 at the beginning of the toner layer stripping mode HM reaches a position opposite to the photosensitive drum 2*a*. Based on the density of the toner 192, the stripping control unit 272 outputs an instruction (the control signal S3) to the voltage control unit 271 for adjusting the second voltage difference VB2 such that the density of the toner 192 decreases.

As described above, the stripping control unit 272 sets the first voltage difference VB1 to form the toner layer 193 and then sets the second voltage difference VB2, and outputs an instruction for adjusting the second voltage difference VB2 by detecting the density of the toner 192 adhering to the intermediate transfer belt 7 during at least one rotation of the developing roller 150 in the toner layer stripping mode HM in the idling state. With these operations performed by the stripping control unit 272, it is possible to reproduce a stripping state of the toner between sheets of paper during successive printing and check correctly the toner stripping performance.

By using the optimal second voltage difference VB2 determined in the idling state as the setting value for subsequent successive image formation, it is possible to constantly and successfully perform toner stripping between printing jobs.

Furthermore, the above embodiment has been described for an image forming apparatus of full-color printing employing an indirect transfer system that transfers toner images of a plurality of colors to a sheet of paper T using the intermediate transfer belt 7. However, the image forming apparatus of the present disclosure is not limited thereto. The present disclosure may be applicable to an image forming apparatus employing a direct transfer system without the intermediate transfer belt, or an image forming apparatus for black-and-white printing. In a case of the image forming apparatus employing the direct transfer system, the operation and effect similar to the above embodiment may be provided by arranging the toner density detection unit 250 at a position opposite to the surface of the photosensitive drum 2*a* and to the surface of a conveyance belt that conveys a sheet of paper.

The image forming apparatus of the present disclosure is not particularly limited, and may be a color copy machine, a printer, a facsimile machine, or a multi-functional peripheral having functions thereof.

The sheet-shaped recording medium is not limited to a sheet of paper T, and may be a film sheet, for example.

I claim:

1. An image forming apparatus comprising:

a developing device;

an image carrier; and a density detection unit, wherein the developing device includes:

a developer supporting rotator configured to magnetically support a two-component developer including at least a carrier and toner, on a surface of which a magnetic brush is formed by the carrier included in the two-component developer;

a toner supporting rotator arranged opposite to the developer supporting rotator and configured to support the toner supplied from the developer supporting rotator and to form a toner layer by the magnetic brush;

a voltage application unit configured to apply a first bias voltage to the developer supporting rotator and a second bias voltage to the toner supporting rotator in order to apply a developing bias voltage between the toner supporting rotator and the image carrier, such that the toner supported by the toner supporting rotator flies to an electrostatic latent image on a surface of the image carrier and develops the electrostatic latent image into a toner image;

a voltage control unit configured to control a voltage difference between the first bias voltage and the second bias voltage applied by the voltage application unit;

a toner layer formation control unit configured to instruct the voltage control unit to set the voltage difference to a first voltage difference at which the toner is bidirectionally movable between the developer supporting rotator and the toner supporting rotator and the toner layer is formed on a surface of the toner supporting rotator; and a stripping control unit configured to instruct the voltage control unit to set the voltage difference to a second voltage difference at which a substantially entire amount of toner composing the toner layer formed on the toner supporting rotator moves to the developer supporting rotator, in a toner layer stripping mode where the toner layer formed on the surface of the toner supporting rotator is stripped during rotation of the toner supporting rotator, wherein an electrostatic latent image is formed on a surface of the image carrier and a toner image is formed on the electrostatic latent image by the toner supplied from the toner layer of the developing device, wherein the density detection unit detects density of toner at any one of the surface of the image carrier, a transfer member onto which the toner image is primarily transferred from the image carrier, and a conveyance member that conveys a sheet of recording medium to which the toner image is transferred from the image carrier, and wherein the stripping control unit outputs an instruction for adjusting the second voltage difference to the voltage control unit, such that the toner flies to the surface of the image carrier and the density is decreased based on the density detected by the toner density detection unit, for a case where the toner remains on the surface of the toner supporting rotator in the toner layer stripping mode.

2. The image forming apparatus according to claim 1, wherein the stripping control unit determines a setting value of the second voltage difference by outputting to the voltage control unit an instruction for adjusting stepwise the second voltage difference in order to gradually reduce the toner density detected by the toner density detection unit in the toner layer stripping mode.

3. The image forming apparatus according to claim 1, wherein the stripping control unit instructs the voltage control unit to set the voltage difference as the second voltage difference by changing only an alternating voltage component of the first bias voltage in the toner layer stripping mode.

4. The image forming apparatus according to claim 2, wherein the stripping control unit instructs the voltage control unit to set the voltage difference as the second voltage difference by changing only an alternating voltage component of the first bias voltage in the toner layer stripping mode.

* * * * *